US008746499B2

(12) United States Patent
Steg

(10) Patent No.: US 8,746,499 B2
(45) Date of Patent: Jun. 10, 2014

(54) CONTAINER

(75) Inventor: Henning Steg, Tyresö (SE)

(73) Assignee: Arta Plast AB, Tyresoe (SE)

( * ) Notice: Subject to any disclaimer, the term of this patent is extended or adjusted under 35 U.S.C. 154(b) by 0 days.

(21) Appl. No.: 11/405,795

(22) Filed: Apr. 18, 2006

(65) Prior Publication Data

US 2006/0186120 A1 Aug. 24, 2006

(51) Int. Cl.
*B65D 41/16* (2006.01)

(52) U.S. Cl.
USPC ..... 220/780; 220/270; 220/305; 220/359.1; 220/359.2; 220/359.3; 220/359.4; 220/793; 215/232; 215/305

(58) Field of Classification Search
USPC ..... 220/305, 359.1, 359.2, 359.4, 377, 270, 220/359.3, 780, 793; 215/305, 232
See application file for complete search history.

(56) References Cited

U.S. PATENT DOCUMENTS

| | | | | |
|---|---|---|---|---|
| 4,946,064 | A * | 8/1990 | VanCucha | 220/795 |
| 6,168,044 | B1 | 1/2001 | Zettle et al. | |
| 6,685,049 | B1 * | 2/2004 | Paladino | 220/781 |
| 7,267,243 | B2 | 9/2007 | Steg | |
| 2003/0015532 | A1 * | 1/2003 | Rickman et al. | 220/212 |
| 2003/0050625 | A1 * | 3/2003 | Lorenzen et al. | 604/891.1 |
| 2004/0245261 | A1 | 12/2004 | Stanos et al. | |
| 2006/0032756 | A1 * | 2/2006 | Justus | 205/139 |

FOREIGN PATENT DOCUMENTS

| | | | | |
|---|---|---|---|---|
| EP | 0 117 673 | | 9/1984 | |
| EP | 0 846 626 | | 6/1998 | |
| GB | 2 030 120 | | 4/1980 | |
| GB | 2 052 455 | | 1/1981 | |
| WO | WO 03/047999 | * | 6/2003 | B65D 77/20 |

* cited by examiner

*Primary Examiner* — Fenn Mathew
*Assistant Examiner* — Elizabeth Volz
(74) *Attorney, Agent, or Firm* — Bacon & Thomas, PLLC

(57) ABSTRACT

In a container for solid, paste-like or flowable products, particularly food products, comprising a lower container part for containing the products and a container top part for closing the container, wherein the container bottom part has a rim which extends around the container bottom part opening, the container top part has a collar element which extends around the rim of the container bottom part and an essentially flat areal cover element connected to the collar element and releasably connected to the rim of the container bottom part when, after filling of the container bottom part with a product, the container is closed by the container top part.

12 Claims, 2 Drawing Sheets

CONTAINER

BACKGROUND OF THE INVENTION

The invention relates to a container for solid, paste-like or flowable products, particularly for food products, comprising a container bottom part for containing the product and a container top part in the form of a container lid and the container bottom part is provided with a rim extending around the circumference of the opening of the container bottom part.

Such containers consist generally of a plastic material and are manufactured by known injection molding techniques. They are commercially available for various applications and in various sizes and are used in many different shapes for all kinds of products which must be packaged hygienically or, respectively, in a sterile manner. Products which are offered in food stores packaged in such containers are for example all kinds of milk products, meat and sausage products, but also vegetable and fruit products as well as ready-to-serve meals in refrigerated or non-refrigerated states.

Since these types of containers are mass products for are containing the exemplary products mentioned above hygienically and in a sterile and air-tight manner, their manufacture must be inexpensive in order to be acceptable to the market that is, the manufacturers of the products and to the consumers. Furthermore, laws and rules require that such containers provide extensive information concerning the content of the container, the composition of the product, the energy content of the product, the manufacturing date, the expiration date and other information required in certain countries, such as health considerations regarding the product contained in the containers.

For this reason, such containers are generally provided with labels which list the various data concerning the product. Often the labels include also the name of the manufacturer, registered marks etc., and generally in many cases, the product contained in the containers is depicted on the label, for example, a sausage product, a cheese product or a product in the form of a liver pate' or similar.

The additional labels however increase the price of manufacture for the container since the label has to be applied after the filling and closing of the container either to the container itself, to the container lid or to the container and the container lid.

Another important problem of such containers resides in the fact that, for example, upon opening of the container by the removal of the lid, which, for the generally known yogurt and cottage cheese containers, consists only of an aluminum foil, the lid does not lift off at the areas where it is joined to the rim of the containers but is ripped upon removal so that it cannot be used again for closing the container if the product is not fully removed or consumed. Another type of closure for such containers wherein an imprinted foil is cemented onto the actual container lid has the disadvantage that, upon removal of the lid for opening the container that foil is ripped off the container lid without the connection between the container lid and the container being released so that the container cannot be opened in this way.

In another type of such known containers, wherein labels are provided during the manufacture of the lid in accordance in the injection mold already with the foil which forms the outer surface of the container lid, an edge area of the foil projecting beyond the container lid is connected to the container. Also this type of containers have a disadvantage in that, in the edge area of the container lid, the circumferentially reinforced label or foil is ripped uncontrollably during opening of the container. In addition, the ruptured sections of the foils which have been applied by the "Inmolded Label" procedure again causes the foil to be ripped off from this container lid uncontrollably and the container can then be opened only by the use of a tool such as scissors or a knife. Of course, a lid opened in this way cannot be used again to cover the container opening when the product contained in the container is not fully removed or consumed. It is a further disadvantage that often the area around the container or the user become soiled when the user tries to open such a container.

In EP-A 1 475 314, which is assigned to the assignee of the present application, a container of this type is disclosed wherein the disadvantages pointed out above in connection with prior art containers and container lids are eliminated in a very elegant and efficient manner.

The utilization of such containers for various products for mass consumption results in the mass-production of the containers and consequently requires inexpensive solutions for the manufacture of such containers. There is always a trend to reduce the costs of such containers which include a top part consisting of an upper outwardly extending foil and a lid on which the foil is disposed.

It is the object of the present invention to provide a container of the type described above, which can be manufactured faster and more easily than the containers described above and which requires less material and which, after the first use, can again be closed with good sealing properties and reopened as often as needed without any loss in sealing properties.

SUMMARY OF THE INVENTION

In a container for solid, paste-like or flowable products, particularly food products, comprising a lower container part for containing the products and a container top part for closing the container, wherein the container bottom part has a rim which extends around the container bottom part opening, the container top part has a collar element which extends around the rim of the container bottom part and an essentially flat areal cover element connected to the collar element and releasably connected to the rim of the container bottom part when, after filling of the container bottom part with a product, the container is closed by the container top part.

The advantage of the arrangement according to the invention resides essentially in the fact that the lid structure comprises a single piece and can, together with the surrounding collar structure which forms a mechanical reinforcement for form-stabilizing the lid, again be used to close the container bottom part to seal the remaining content of the container.

Furthermore, with the solution according to the invention, the areal cover element is used for displaying the visual information and, at the same time, forms the actual cover element.

In an advantageous embodiment of the invention, the collar structure includes a web area which releasably engages a web structure of the container bottom part extending around the container opening. In this releasable connection between the container top part and the container bottom part only the mechanically stable essentially rigid collar element is involved that is the material requirements for the manufacture of the container top part can be limited to the formation of the collar element, whereas the cover element as such is very thin that is in the form of a foil sufficient for fulfilling the function of hermetically closing the container bottom part.

In accordance with another advantageous embodiment of the container, the web of the collar element and a web of the container bottom part formed in the area of the collar element extend essentially in parallel relationship when they are interconnected. In this way, it is made sure in an advantageous and simple manner that the web of the container bottom part forms a guide structure for the web of the collar element of the container top part so that the container top part can be moved under the guidance of the webs onto the container bottom part during the closing procedure, up to the point where the collar element can then engaged with the container bottom part by a snap-in connection.

In accordance with still another advantageous embodiment of the invention, the part of the clip-connection provided at the collar element is formed by a projection at the web which, in the interconnected state, extends behind the free end of the web of the lower container part. With such a clip connection between the upper container part and the lower container part a firm and hermetically tight closure is formed which, even after multiple opening and closing of the container, ensures continued mechanical sealing engagement which prevents the invasion of germs from the ambient into the container interior.

Preferably, the rim around the lower container part extends from the container wall outwardly at a right angle whereby it can be made sure, in a simple manner, that the collar element can safely be supported at least partially on the lower container part when the container is closed, that is the upper part is interlocked with the lower part. The circumferential rim which extends essentially at a right angle from the container bottom part has furthermore the advantage that the mechanical stability of the lower container part is increased at least in the area of the jointure with the upper container part, where the upper container part comes into contact with the lower container part so that the other areas of the lower container part can be quite thin-walled so as to save material weight and costs.

It is advantageous if on the circumferential rim of the lower container part a projection is provided to which the cover element is removably connected. "Removably connected" means in this connection that, after the filling of the product into the lower container part, the container top part is placed onto the container bottom part and then, in order to hermetically seal the container content, that area is sealed by a suitable joint such as a weld and/or a cement joint. For the opening of the container by lifting the upper container part and disconnecting the clip connection between the upper container part and the lower container part, the area of the element or, respectively, weld joint is disconnected without destruction of the upper or the lower container part.

The cover element as such consists in an advantageous embodiment of the container of a foil-like structure which is formed integrally with the circumferential collar element. This can be achieved technically in that the whole container top part is manufactured in a single injection molding procedure in a suitable injection mold. At the same time, using the already mentioned IML procedure, the visual information concerning the content of the container and other information can be applied during the manufacture of the upper container part so that it is visible from the outside.

In an advantageous embodiment, the cover element consists a foil-like body which is connected to the collar element by a suitable joint, for example, by welding and/or cementing. Although, in this case, wherein the cover element and the collar element are separately manufactured, the upper container part is more expensive, it permits the use of different materials for the collar element on one hand and the cover element on the other which may be necessary depending on requirements.

The thickness of the areal cover element can be selected in a wide range, depending on the size of the container, the content of the container, the product to be contained in the container and the material used for the manufacture of the container, that is it can be adapted to the packaging problem to be accommodated by the container. However, in order to keep the consumption of the necessary material for forming the cover element as low as possible, the thickness of the cover element is advantageously between 0.1 and 0.3 mm.

For the manufacture of the areal cover element and/or the manufacture of the collar element and/or the manufacture of the lower container part, preferably an injection molding material such as polypropylene is used. However, also other suitable injection molding materials may be used as long as they are neutral with respect to the product contained in the container that is they do not affect the product in its consistency, its taste or its quality etc.

The material of the cover element may be so selected that it is transparent which has the advantage that the product contained in the container can be observed with the container closed.

The releasable connection of the container top part with the collar element of the container bottom part after the product has been filled in the container, that is in order to subsequently hermetically close the container by the upper container part, can be established by a weld connection. Preferably, the weld connection is a melt-weld connection. The connection, however, may also be established by a suitable cement connection. Independently of whether the connection is a weld connection or a cement connection, it is such that it is released upon opening of the container, that is, upon removal of the container top part from the container bottom part without causing any damage to the cover element or the container top part and the container bottom part.

Below the invention will be described in greater detail on the basis of the accompanying drawings:

DESCRIPTION OF A PREFERRED EMBODIMENT

Figure 1:
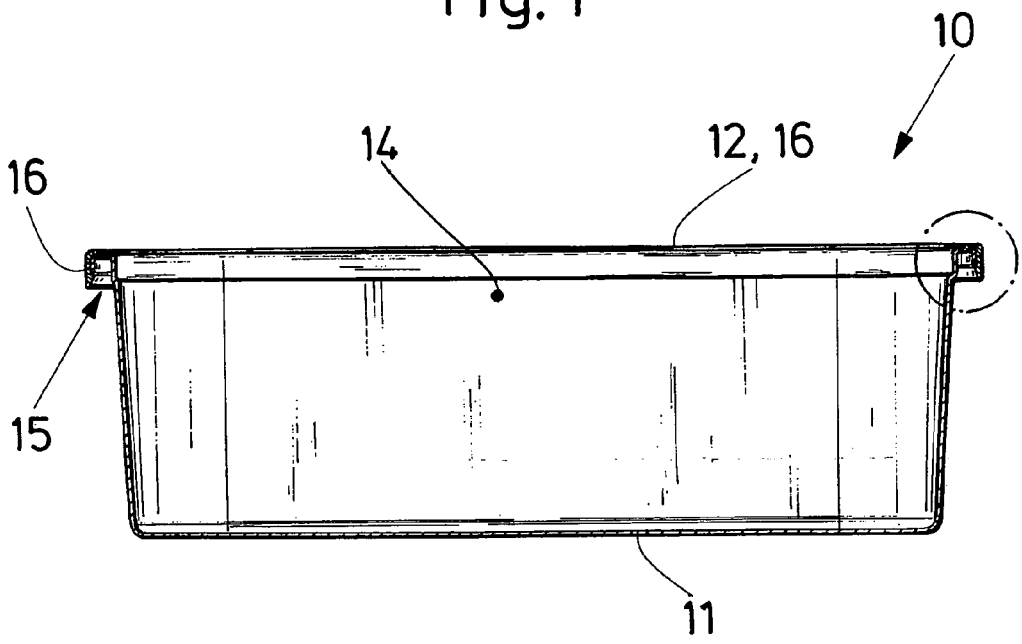
FIG. 1 is a sectional view of the container taken along line A-B of FIG. 2 and showing the container bottom part with a container top part disposed on the container bottom part.
Figure 2:
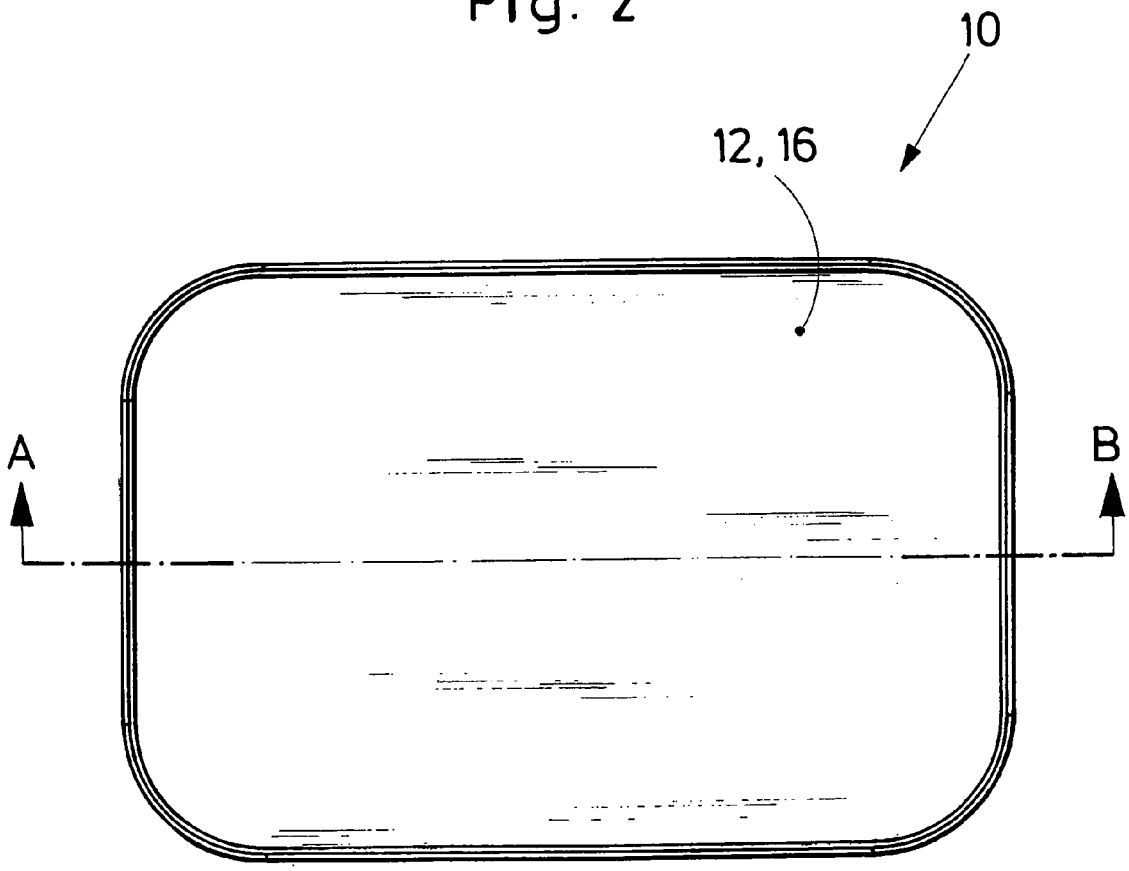
FIG. 2 is a top view of the container.

The container 10 as shown in FIGS. 1 and 2 is adapted to receive solid, paste-like and flowable products, particularly food products. However, the container 10 may also accommodate, in a sterile manner, medical devices or medical equipment such as bandaging material or other small parts. After being filled with particular products and then hermetically closed, the container is sealed and the products contained in the container are kept sterile.

The container 10 comprises a lower container part 11 for containing the product. The container bottom part 11 includes a container opening 14 which is closed by a container top part 12, see FIGS. 1 and 2.

The container bottom part includes a rim 15 which extends around the container opening 14 and projects outwardly therefrom at essentially a right angle with respect to the side walls of the lower container part 11. It is pointed out that the container bottom part 11 does not need to have the square shape shown in the figures but may have any other shape such as a round or oval cross-section. The rim 15 extending from the side walls of the lower container part 11 at an essentially right angle is provided in such a way that it extends parallel to a plane on which the container bottom part 11 is supported.

Since such containers 10 are known, the design features of the lower container part are described below only as far as the inventive design features are concerned.

The container includes, in addition to the container bottom part 11, a container top part 12 that is the container lid. The container top part, that is the container lid consists of a collar element 16—see also FIG. 3, which shows the part D of FIG. 1—and of an essentially areal cover element 17 which is clearly visible in FIG. 3. The areal cover element 17 is much thinner than the other walls of the container bottom part 11 and the collar element 16 which will be described in greater detail below.

Figure 3:
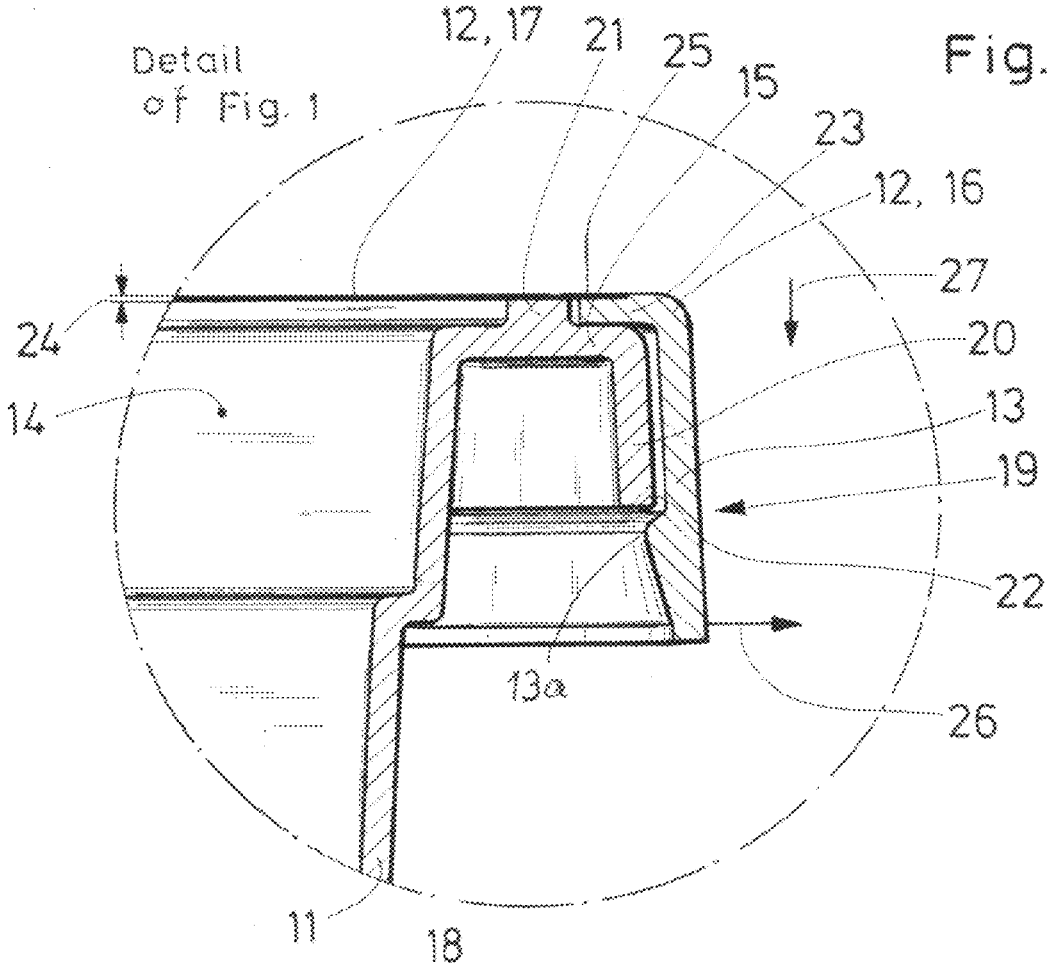
FIG. 3 is an enlarged detail view of the circled area D of FIG. 1 with the container top part snapped onto the container bottom part.

The collar element 16 is a single piece molded part which extends around the container opening, that is it surrounds the container opening in a collar-like fashion, see particularly FIG. 3. The collar element 16 forms a frame which encloses the areal cover element 17.

The collar element 16 comprises essentially two areas, that is a web-like area 19 which extends essentially at a right angle to the container top part 12 or, respectively, the container lid and projects therefrom downwardly, and a rim area 23 which extends essentially parallel to cover element 17.

The rim 15 extending around the container opening 14 of the lower container part 11 is also provided at its circumferential outer end with a downwardly projecting web 20 extending also around the container opening 14.

The web 13 of the upper container part and the web 20 of the lower container part form parts of a snap-in connection whereby the web 13 of the collar element 16 and the web 20 of the lower container part are engaged with each other. The web 13 and the web 20 extend essentially parallel adjacent one another. In the embodiment shown in the figures the webs extend downwardly from the plane of the cover element 17 and the plane of the rim 15 of the lower container part at an angle which is a few degrees greater than 90°.

The snap-in connection 18 is formed specifically by a projection 13*a* formed on the web 13 which, in the engagement position, extends below the free end 22 of the web 20 of the lower container part 11. As already mentioned, the cover element 17 consists of a foil-like body which has a thickness 24 in the area of 0.1 to 0.3 mm. The cover element 17, that is the foil-like body, is in a preferred embodiment of the container 10 formed integrally with the collar element 16. Such a container top part 12 can be manufactured in a single injection molding step.

However, the cover element 17 may also be manufactured separately as a foil body which is then connected to the circumferential collar element 16 for example by welding or cementing. In that case, the rim 23 of the collar element 16 may include a circumferential recess 25 corresponding to the thickness 24 of the cover element 17 as apparent from FIG. 3. The cover element 17 can then be placed into this recess in the rim 23 guided by the outer edge of the recess, and firmly connected to the rim 23 by welding or cementing.

On the circumferential rim 15 of the lower container part 11 a projection 21 is provided which projects upwardly from the rim 15. When the container top part 12 is disposed on the container bottom part 11, the cover element 17 is disposed on this projection 21 and the collar element 16 is disposed on the part of the circumferential rim 15 which is next to the projection 21, see FIG. 3.

Figure 4:
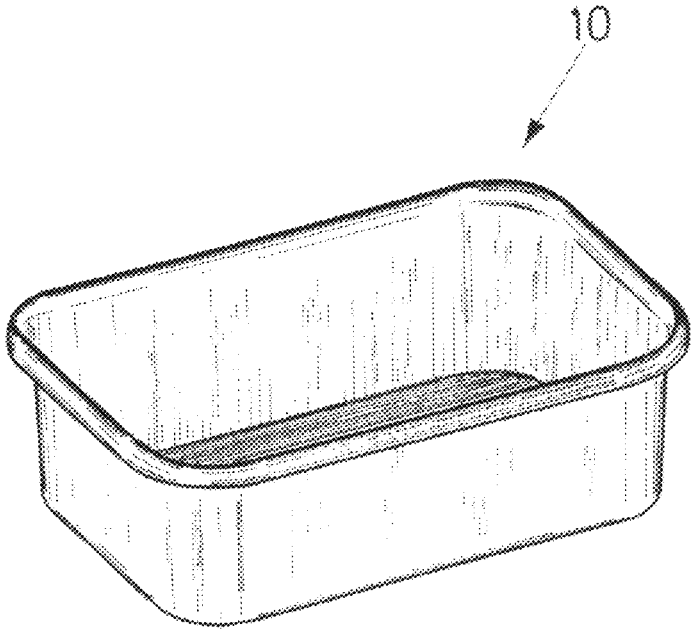
FIG. 4 is a perspective view of the container bottom part with the container top part removed.

When the container bottom part 11 and the container top part 12 have been manufactured in the form as described above, the container bottom part 11 is filled with the product (see FIG. 4) by the manufacturer of the product to be contained in the container 10. The container top part 12 is placed onto the container bottom part 11 and pressed down so that the web 20 of the lower container part 1 and the web 13 of the upper container part 12 snap into mutual engagement. Then the cover element 17 is disposed on the projection 21 and the collar element 16 is disposed on the rim 15 of the container bottom part 11 and the cover element 17 is welded or cemented to the projection 21.

The container bottom part 11 may be filled and subsequently be welded tight in a vacuum.

For removing the container top part 12 from the container bottom part 11, the user may reach with his fingers below the web 13 of the container top part 12 which extends further down than the web 20 of the lower container pat and bend it outwardly in the direction of the arrow 26. Since the material used for the manufacture of the container bottom part 11 and the container top part 12, which are injection molded, is elastic the web 13 can be elastically deformed in the direction of the arrow 26 so as to release the engagement thereof with the web 20 of the container bottom part 11. Then the container top part 12 can be raised whereby the welding or cementing connection between the projection 21 and the cover element 17 is released. The welding or cementing connection is so prepared that it is released relatively easily without damage to the projection 21 or the cover element 17. If the container top part 12 is further raised by tilting it upwardly, the connection between the projection 21 and the cover element 17 is released over the whole circumference of the container opening 14. Upon removal of the container top part 12 as a whole, the product can be removed from the container bottom part.

If the container bottom part 11 is subsequently to be closed again the container top part 12 as again placed onto the container bottom part 11 and pressed downward in the direction of the arrow 27 until the web 13 of the container top part 12 snaps again onto the web 20 of the container bottom part 11 for engagement therewith. The product remaining in the container bottom part is then again enclosed in an essentially airtight manner for continued storage.

If the foil-like cover element 17 consists of a transparent material, the user of the container can see and inspect the container content also when the container 10 is closed which is advantageous for presentation purposes of the container when displayed on shelves or refrigeration containments.

What is claimed is:

1. A container (10) for solid, paste-like and flowable products, comprising:

a lower container part (11) with an opening (14) for containing the product and a container top part (12) in the form of a container lid, said lower container part (11) having a rim with a top wall (15) and a downwardly extending rim web (20) extending all around the container opening (14), the top wall (15) having an annular upwardly extending projection (21) and the container top part (12) comprising a collar element (16) also extending all around the container opening (14) and the rim (15, 20) of the lower container part (11), the collar element (16) including a rim area (23) extending inwardly over the container rim top wall (15) up to the upwardly extending annular projection (21) and an essentially flat areal cover element (17) provided on the collar element (16) and releasably directly connectable to the annular upwardly extending projection (21) of the container rim top wall (15) which is arranged adjacent the inwardly extending rim area (23) so that the areal cover element (17) is sealingly disposed directly on the annular upwardly extending projection (21) when the container is closed to seal the container.

2. The container according to claim 1, wherein the rim (15, 20) of the lower container part (11) extends essentially at a right angle from the container bottom part (11).

3. The container according to claim 1, wherein the areal cover element (17) consists of a foil body which is connected to the collar element (16) by a weld connection.

4. The container according to claim 1, wherein the areal cover element (17) has a thickness of 0.1 to 0.3 mm.

5. The container according to claim 1, wherein at least the areal cover element (17) consists of polypropylene.

6. The container according to claim 1, wherein the areal cover element (17) consists of a foil body which is formed integrally with the surrounding collar element (16).

7. The container according to claim 6, wherein the areal cover element (17) and the surrounding collar element (16) are formed together in an injection molding procedure.

8. The container according to claim 1, wherein at least the areal cover element (17) consists of a transparent material.

9. The container according to claim 3, wherein the areal cover element (17) is connected to the collar element by a melt-weld connection.

10. The container according to claim 1, wherein the collar element (16) includes a web area (19) forming a snap-on connection (18) formed by a projection (13*a*) of the collar element (16) engaging a circumferential web (20) of the rim (15, 20) of the lower container part (11).

11. The container according to claim 10, wherein the collar element (16) includes a collar web (13) which extends tightly and in parallel relationship around a rim web (20) of the lower container part (11) for mutual engagement.

12. The container according to claim 11, wherein the collar element (13) on which the snap-on projection (13*a*) is formed to extend downwardly beyond the projection (13*a*) so that it is graspable by a user for releasing the connection.

* * * * *